US008979243B2

(12) United States Patent
Igawa

(10) Patent No.: US 8,979,243 B2
(45) Date of Patent: Mar. 17, 2015

(54) INKJET PRINTING APPARATUS, CLOGGED NOZZLE RECOVERING METHOD AND CLOGGED NOZZLE RECOVERY PROGRAM

(71) Applicant: Mimaki Engineering Co., Ltd., Nagano (JP)

(72) Inventor: Tomomi Igawa, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 14/078,536

(22) Filed: Nov. 13, 2013

(65) Prior Publication Data

US 2014/0132665 A1 May 15, 2014

(30) Foreign Application Priority Data

Nov. 14, 2012 (JP) ..... 2012-250707

(51) Int. Cl.
*B41J 2/165* (2006.01)

(52) U.S. Cl.
CPC ..... *B41J 2/16532* (2013.01)
USPC ..... 347/30

(58) Field of Classification Search
CPC .... B41J 2/155; B41J 2/16505; B41J 2/16508; B41J 2/16511; B41J 2/1652; B41J 2/16523; B41J 2/16532; B41J 2/16547; B41J 2/16585
USPC ..... 347/5–7, 14, 29, 30, 84, 85
See application file for complete search history.

(56) References Cited

U.S. PATENT DOCUMENTS

| | | | | |
|---|---|---|---|---|
| 2007/0222815 | A1* | 9/2007 | Kusakari | 347/29 |
| 2010/0118082 | A1* | 5/2010 | Tojo | 347/30 |
| 2010/0231641 | A1* | 9/2010 | Danzuka | 347/30 |
| 2011/0227998 | A1* | 9/2011 | Kamiyama | 347/29 |
| 2012/0056932 | A1* | 3/2012 | Matsubara et al. | 347/30 |
| 2012/0223981 | A1* | 9/2012 | Koike et al. | 347/6 |
| 2012/0242733 | A1* | 9/2012 | Ishinaga et al. | 347/14 |
| 2014/0132664 | A1* | 5/2014 | Igawa et al. | 347/30 |

FOREIGN PATENT DOCUMENTS

JP 02-000525 1/1990

* cited by examiner

*Primary Examiner* — Manish S Shah
*Assistant Examiner* — Roger W Pisha, II
(74) *Attorney, Agent, or Firm* — Jianq Chyun IP Office

(57) ABSTRACT

An inkjet printing apparatus, a clogged nozzle recovering method, and a clogged nozzle recovery program are provided. The inkjet printing apparatus includes a head, a tank, a first pump, a cap, a second pump and a control means. The head is provided with a nozzle face and a plurality of nozzles. The tank is connected with the head through a tube. The first pump is connected with the tank and maintains the tank at a constant negative pressure. The cap for suction covers a part of the nozzles on the nozzle face of the head. The second pump is connected with the cap for sucking an inside of the cap. The control means controls to lower the negative pressure of the tank that is maintained by the first pump when the inside of the cap is sucked by the second pump.

6 Claims, 10 Drawing Sheets

FIG. 3(a)
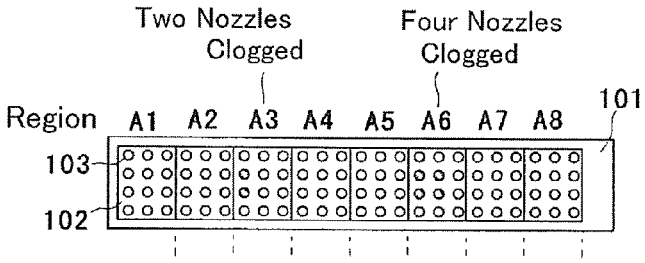
FIG. 3(b)
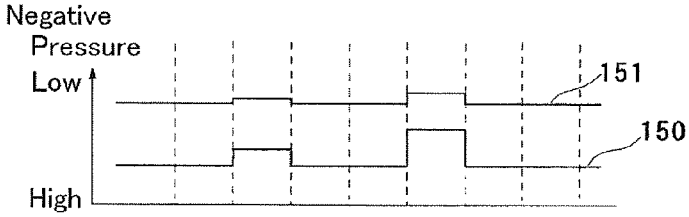
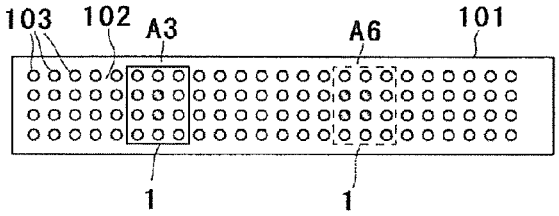
FIG. 4

INKJET PRINTING APPARATUS, CLOGGED NOZZLE RECOVERING METHOD AND CLOGGED NOZZLE RECOVERY PROGRAM

CROSS-REFERENCE TO RELATED APPLICATIONS

This application claims the priority benefit of Japan application serial no. 2012-250707, filed on Nov. 14, 2012. The entirety of the above-mentioned patent application is hereby incorporated by reference herein and made a part of this specification.

BACKGROUND OF THE INVENTION

1. Field of the Invention

The present invention relates to an inkjet printing apparatus structured to recover a clogged nozzle by sucking aggregate or the like clogged in the nozzle, and to a clogged nozzle recovering method and a clogged nozzle recovery program.

2. Description of Related Art

FIG. 11 is a structural view showing a cap unit which is used for recovering a conventional inkjet head. The cap unit 900 includes a cap 903 which is abutted with a nozzle face 902 where a plurality of nozzles 901 is formed, a belt member 904 which supports and moves the cap 903 and covers the nozzle face 902, and pulleys 905 and a motor (not shown) for moving the belt member 904. A tube 906 is connected with the cap 903 and the tube 906 is connected with a waste liquid tank (not shown).

In the cap unit 900, the belt member 904 is moved to a portion of the nozzles 901 in which aggregate is clogged and the cap 903 is located at the portion to suck the nozzle 901 through the cap 903. The belt member 904 is abutted with the nozzle face 902 so as to close the nozzles 901 which are not sucked.

CITATION LIST

Patent Literature

[PTL 1] Japanese Patent Laid-Open No. Hei 2-525

SUMMARY OF THE INVENTION

However, in the conventional cap unit 900, since the nozzle face 902 is closed by the belt member 904 during a process for recovering from clogging of the nozzle 901, there is a possibility that ink enters into a gap space between the belt member 904 and the nozzle face 902 to ooze out and a meniscus of the nozzle 901 is broken.

In view of the problem described above, an objective of the present invention is to recover a clogged nozzle without breaking a meniscus of a nozzle.

An inkjet printing apparatus in accordance with the present invention includes a head which is provided with a nozzle face and a plurality of nozzles provided on the nozzle face for discharging ink, a tank which stores ink and is connected with the head through a tube, a first pump which is connected with the tank and maintains the tank at a constant negative pressure, a cap for suction which covers a part of the plurality of nozzles on the nozzle face of the head, a second pump which is connected with the cap for sucking an inside of the cap, and a control means which controls to lower the negative pressure of the tank that is maintained by the first pump when the inside of the cap is sucked by the second pump.

According to the present invention, since the negative pressure in an inside of the tank is lowered by the first pump when an inside of the cap is sucked by the second pump, excessive increase of a negative pressure in an inside of the head caused by suction in the cap by the second pump is canceled. As a result, the clogging of the nozzle can be recovered while preventing breakage of a meniscus of a nozzle. The tank may include ink tanks in addition to a sub-tank and the head itself may function as the tank.

Further, in the inkjet printing apparatus, it may be structured that the control means controls suction of the first pump based on the number of plurality of nozzles without being clogged in a region where the cap is not covered.

Further, in the inkjet printing apparatus, it may be structured that when the negative pressure in the inside of the tank is lowered by the first pump, the control means sucks the inside of the cap with a first pressure lower than a negative pressure which breaks a meniscus of the plurality of nozzles without being clogged in a region which is not covered with the cap, after that, the control means sucks the inside of the cap with a second pressure which is a negative pressure higher than the first pressure.

Further, in the inkjet printing apparatus, it may be structured that a leak judgment means is provided which judges leakage of the cap before suction is performed by the first pump.

Next, a clogged nozzle recovering method in accordance with the present invention includes a covering step in which a part of a plurality of nozzles formed on a nozzle face of a head of an ink jet printer are covered with a cap, a pressurizing step in which an inside of a tank storing ink that is connected with the head through a tube is pressurized by a first pump, and a suction step in which an inside of the cap is sucked by a second pump connected with the cap at a pressure lower than a negative pressure which breaks a meniscus of the plurality of nozzles in a region where the cap is not covered.

Further, the clogged nozzle recovering method may include a nozzle recovery judgment step which judges recovery of the plurality of nozzles by comparing a reference pressure value with a pressure value, wherein the reference pressure value is obtained when the plurality of nozzles without being clogged are covered with the cap and sucked and is stored beforehand, the pressure value is obtained when the plurality of nozzles are covered with the cap and sucked.

Further, in the suction step of the clogged nozzle recovering method, when a negative pressure of the tank is lowered by the first pump, it may be controlled that the inside of the cap is sucked with a first pressure which does not break a meniscus of the plurality of nozzles without being clogged in the region which is not covered with the cap, after that, the inside of the cap is sucked with a second pressure which is a negative pressure higher than the first pressure.

Further, the clogged nozzle recovering method may include a leak judgment step in which leakage of the cap is judged by comparing a pressure value with a threshold value, wherein the pressure is a value of a pressure when sucking the inside of the cap is stored beforehand for leak judgment.

Next, a clogged nozzle recovery program in accordance with the present invention executes a covering step in which a part of a plurality of nozzles formed on a nozzle face of a head of an ink jet printer are covered with a cap, a suction step in which an inside of a tank storing ink that is connected with the head through a tube is sucked by a first pump, and a suction step in which an inside of the cap is sucked by a second pump connected with the cap at a pressure lower than a negative pressure which does not break a meniscus of the plurality of nozzles in a region where the cap is not covered.

According to the present invention, a clogged nozzle can be recovered without breaking a meniscus of a nozzle. Further, recovery of the nozzle can be also judged.

BRIEF DESCRIPTION OF THE DRAWINGS

FIGS. 3(*a*) and 3(*b*) are explanatory views showing a process in which the number of clogged nozzles is detected.

FIG. 4 is an explanatory view showing a process in which the number of clogged nozzles is detected.

DETAILED DESCRIPTION OF THE INVENTION

First Embodiment

Figure 1:
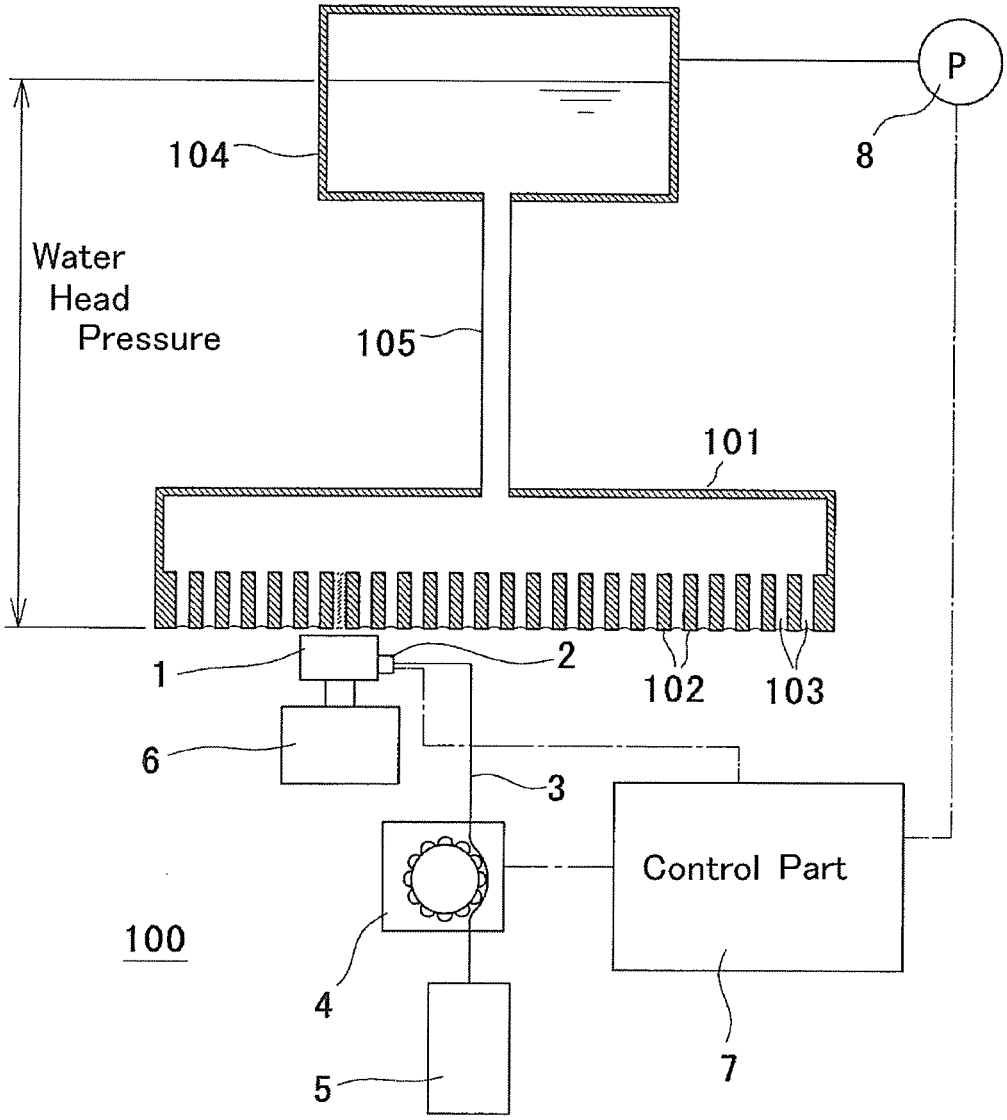
FIG. 1 is a structural view showing a nozzle suction device in an inkjet printer in accordance with a first embodiment of the present invention.

FIG. 1 is a structural view showing a nozzle suction device in an inkjet printer in accordance with a first embodiment of the present invention. The nozzle suction device 100 includes a cap 1 which is stuck to a nozzle face 102 of a head 101 of an inkjet printer to suck ink in an inside of the nozzle, a tube 3 connected with the cap 1, a pressure sensor 2 which is connected with a downstream side of the cap 1 for acquiring a pressure in an inside of the cap 1, a second pump 4 connected with the tube 3, a waste liquid tank 5 connected with a downstream side of the second pump 4 through the tube 3, an actuator 6 such as an air cylinder which moves the cap 1 up and down, a control part 7 which drives and controls the actuator 6 and the second pump 4, and a first pump 8 connected with a sub-tank 104 provided in the head 101.

A plurality of nozzles 103 is provided in a nozzle face 102 of the head 101. The sub-tank 104 is connected with the head 101 through a tube 105. The sub-tank 104 is provided in a carriage (not shown), which holds the head 101, and stores ink and functions as a damper which suppresses pressure fluctuation. A predetermined pressure value which is capable of forming a meniscus on the nozzle face 102 is obtained by setting the inside of the sub-tank 104 at a negative pressure. Control for the negative pressure is performed by the control part 7.

The cap 1 is formed of a box-shaped body and its face on a suction side facing the nozzle face 102 is opened and its opening end edge is structured of sealing material such as rubber which is capable of maintaining an airtight property with the nozzle face 102. Further, the cap 1 covers a part of a plurality of nozzles 103 which are formed on the nozzle face 102. In this embodiment, the nozzle face 102 is divided into a plurality of regions and the cap 1 covers a part of the plurality nozzles 103. A size of the cap 1 is determined depending on the number of the nozzles and the size of the nozzle face 102.

The nozzle face 102 of the head 101 is formed with a large number of the nozzles 103. In the first embodiment, as shown in FIGS. 3 and 4, the nozzle face 102 is formed with the nozzles 103 of, for convenience of description, vertically 4 lines and laterally 25 rows as an arrangement example of the nozzles 103. Further, the head 101 is connected with the sub-tank 104 through the tube 105.

Figure 2:
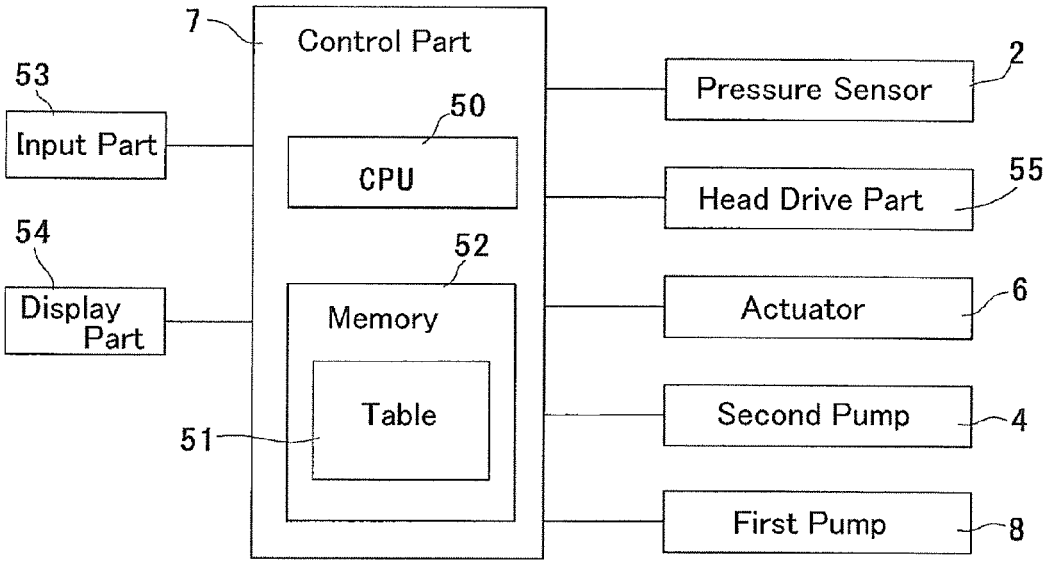
FIG. 2 is a block diagram showing the nozzle suction device in FIG. 1.

FIG. 2 is a block diagram showing the nozzle suction device in FIG. 1. The control part 7 includes a CPU (Central Processing Unit) 50 which performs arithmetic processing and a memory 52 which stores programs for executing processes described below and a table 51 in which information such as pressure values described below is stored for respective numbers of the nozzles. The control part 7 is connected with an input part 53 such as an operation panel and a display part 54 such as a liquid crystal panel. Further, the pressure sensor 2, a head drive part 55 for driving the head 101, the actuator 6, the second pump 4 and the first pump 8 are electrically connected with the control part 7. The control part 7 includes driver circuits for the actuator 6, the second pump 4 and the first pump 8.

In accordance with an embodiment of the present invention, programs which instruct the control part 7 may be stored in a memory means, an outside computer (including a resource form built in Internet space) and the like which are capable of being connected with the inkjet printer. Further, a value which is a threshold value for judgment described below is obtained depending on experiments or the like and is stored in the table 51. In addition, all controls for processes for detecting the number of clogged nozzles and its position and for recovering the nozzles are executed by the control part 7 based on programs for executing the corresponding control processes.

Detection of Number of Clogged Nozzle and Position

Figure 5:
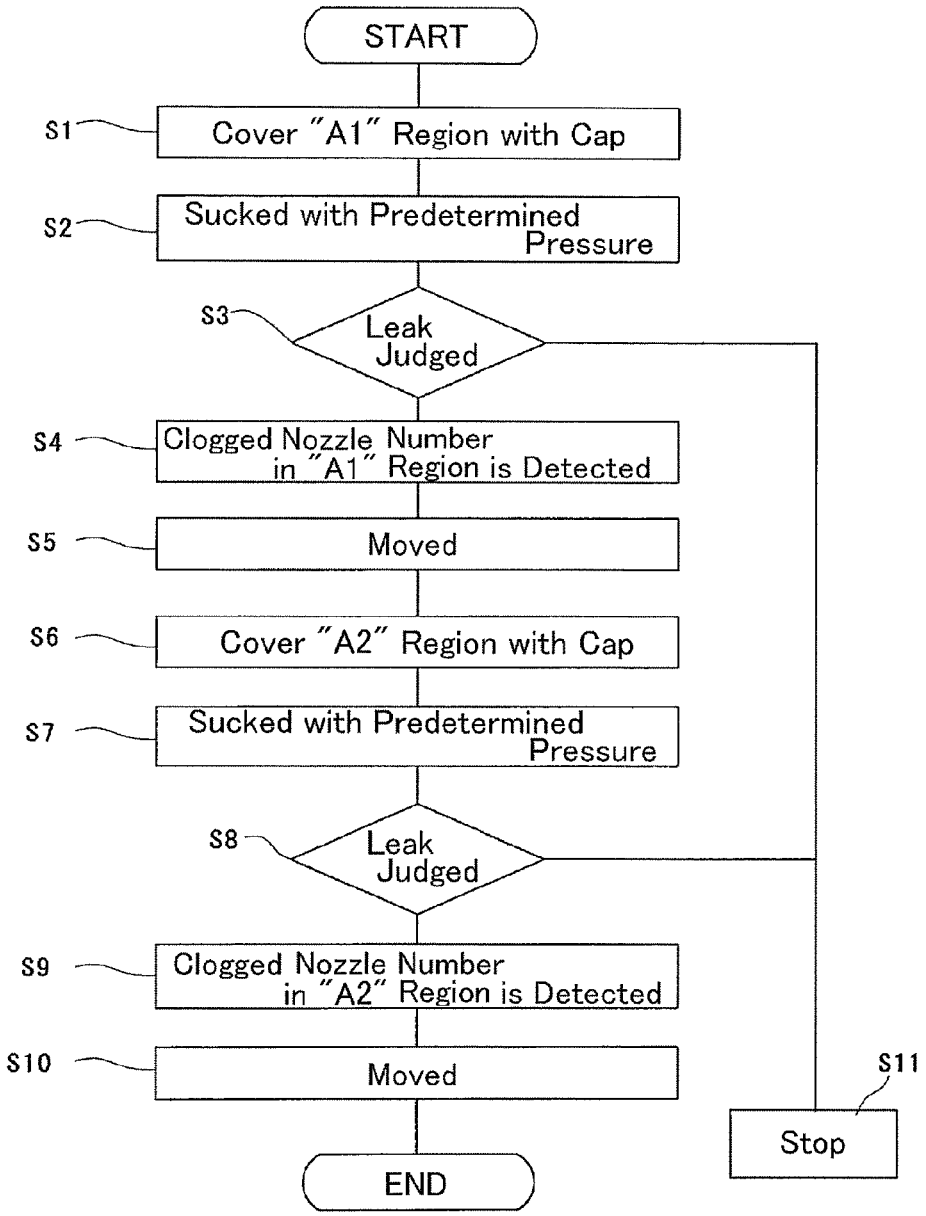
FIG. 5 is a flow chart showing a process in which the number of clogged nozzles is detected.

FIGS. 3 and 4 are explanatory views showing a process in which the number of clogged nozzles is detected. FIG. 5 is a flow chart showing a process in which the number of clogged nozzles is detected. An end part on an opening side of the cap 1 is formed in a rectangular shape in a plan view and, when a longer direction of the nozzle face 102 is a lateral direction, the number of the nozzles which are capable of being covered by the cap 1 is four nozzles in a vertical direction and three nozzles in the lateral direction, i.e., totaled 12 nozzles.

In order to detect the number of clogged nozzles, the carriage is moved by the head drive part 55 of the inkjet printer to locate the "A1" region of the head 101 above the cap 1 and then the cap 1 is moved upward by the actuator 6 so as to cover the "A1" region (step S1). The "A1" region corresponds to a portion where four nozzles 103 in the vertical direction and three nozzles 103 in the lateral direction are located from a left edge of the nozzle face 102 in the drawing. A rectangular end edge of the cap 1 abutted with the nozzle face 102 is tightly contacted with a flat face portion of the nozzle face 102 to separate the inside of the cap from the outside.

In this state, the second pump 4 is driven to suck the inside of the cap 1 (step S2). A pressure in the inside of the cap 1 is monitored by the pressure sensor 2 and it is judged whether leakage occurs in the cap 1 or not based on an output value from the pressure sensor 2 (step S3). In this case, a pressure used for a leak judgment is set higher (the negative pressure is set to be lower) than a pressure used for judging the number of the clogged nozzles 103. In other words, sucking is performed with a suction force smaller than a suction force at the time of nozzle suction, that is, the negative pressure in the inside of the cap 1 is lowered to a pressure to the extent that ink is not sucked from the nozzle 103 to eliminate influence of an outflow of the ink from the nozzle 103. In this manner, a leak judgment can be performed independently of a judgment of the number of the clogged nozzles.

In a case that leakage does not occur in the cap 1, as shown in FIG. 3(*b*), a pressure value substantially the same as a leak judgment reference pressure value 150 is detected by the pressure sensor 2. The leak judgment reference pressure value 150 is a pressure value in the inside of the cap 1 at the time of sucking with a suction force when leakage does not occur and is acquired experimentally beforehand. The reference pressure value is determined depending on a shape of each nozzle 103 and ink characteristics. For example, in the "A1" region, a pressure value detected by the pressure sensor 2 when leakage does not occur is substantially the same as the leak judgment reference pressure value 150.

On the other hand, when leakage occurs in the cap 1, as shown in FIG. 3(*b*), the cap 1 is unable to be sucked to the leak judgment reference pressure value 150. For example, the negative pressure of the pressure value 151 detected in the "A1" region is lower than the leak judgment reference pressure value 150 due to entering of air from the outside. In this case, it is judged that leakage has occurred in the cap 1 and detection of the number of the clogged nozzles 103 is stopped.

Next, the number of the clogged nozzles 103 is detected in the "A1" region (step S4). A pressure used for detecting the number of the clogged nozzles is a negative pressure which is higher than the leak judgment reference pressure value 150 but is lower than a negative pressure for performing a nozzle recovery described below. In other words, since it is sufficient to distinguish clogged nozzles 103 through which ink does not flow, the nozzle is sucked with a pressure which is enough to flow out ink from the nozzle 103. The control part 7 sucks the inside of the cap 1 to acquire an output value of the pressure sensor 2. The control part 7 holds reference data of pressure values for respective numbers of the nozzles in the table 51 and a pressure value which is actually detected is compared with the reference data to determine the number of the clogged nozzles 103 for each region. In this example, there is no clogged nozzles 103 in the "A1" region. Therefore, the reference data and the acquired actual pressure value are substantially the same as each other.

Next, when the detection in the "A1" region is finished, the cap 1 is moved downward by the actuator 6 and the carriage is moved so that an "A2" region of the head 101 is located above the cap 1 (steps S5 and S6). Then, the cap 1 is moved upward by the actuator 6 to cover the "A2" region (step S7). Then, also in the "A2" region, leak and the number of the clogged nozzles 103 are judged based on the similar processing to the "A1" region (steps S8 and S9). In this example, it is determined that there is no clogged nozzles 103 also in the "A2" region.

Next, when the detection in the "A2" region is finished, the cap 1 is moved downward by the actuator 6 and the carriage is moved so that an "A3" region of the head 101 is located above the cap 1 and then, the cap 1 is moved upward by the actuator 6 to cover the "A3" region (step S10, in the flow chart, succeeding steps are repeatedly performed and thus, not shown). Then, similar judgment processing is executed also for the "A3" region. Detection of leakage is similarly executed as described above. When leakage does not occur, the number of the clogged nozzles 103 is judged. In the "A3" region, it is assumed that two nozzles 103 are clogged. When two nozzles 103 are clogged, since ink is sucked from remaining ten nozzles 103 and thus, as shown in FIG. 3(*b*), the negative pressure in the inside of the cap 1 becomes higher. The control part 7 compares a pressure value actually acquired with the reference data and the number of the clogged nozzles 103 is determined to be two.

Next, when the detection in the "A3" region is finished, the cap 1 is moved downward by the actuator 6 and the carriage is moved so that the "A4" region of the head 101 is located above the cap 1 and then, the cap 1 is moved upward by the actuator 6 to cover the "A4" region. And, also in the "A4" region, leak and the number of the clogged nozzles 103 are judged based on the similar processing to the "A1" through "A3" regions. In this example, it is determined that there is no clogged nozzles 103 also in the "A4" region. Further, similar processing is also executed for the "A5" region.

Next, when the detection in the "A5" region is finished, the cap 1 is moved downward by the actuator 6 and the carriage is moved so that the "A6" region of the head 101 is located above the cap 1 and then, the cap 1 is moved upward by the actuator 6 to cover the "A6" region. Then, similar judgment processing is also executed for the "A6" region. Detection of leak is similarly executed as described above. When leakage does not occur, the number of the clogged nozzles 103 is judged. In the "A6" region, it is assumed that four nozzles 103 are clogged. When four nozzles 103 are clogged, since ink is sucked from remaining eight nozzles 103 and thus, as shown in FIG. 3(*b*), the negative pressure in the inside of the cap 1 becomes higher. The control part 7 compares a pressure value actually acquired with the reference data and the number of the clogged nozzles 103 is determined to be four.

Next, when detection in the "A6" region is finished, the "A7" region is covered with the cap 1. And, also in the "A7" region, leak and clogging of the nozzles 103 are judged based on the similar processing to the "A6" region. In this example, it is determined that there is no clogged nozzles 103 in the "A7" region Similar processing is also executed for the "A8" region.

In this manner, leak and the number of clogged nozzles in each region are judged while the cap 1 and the nozzle face 102 are relatively moved to each other over respective regions. Positions of the clogged nozzles 103 are acquired by the region unit. The judgment results are stored in a location (memory 52 or the like) which is capable of being read from the control part 7.

In a case that a judgment of the number of clogged nozzles is stopped due to leakage, the number of clogged nozzles may be judged by another means. For example, clogged nozzles 103 may be judged by printing a check pattern for the nozzles 103 or may be judged by taking an image of the nozzles 103 with a camera.

Recovery of Nozzle

Figure 6:
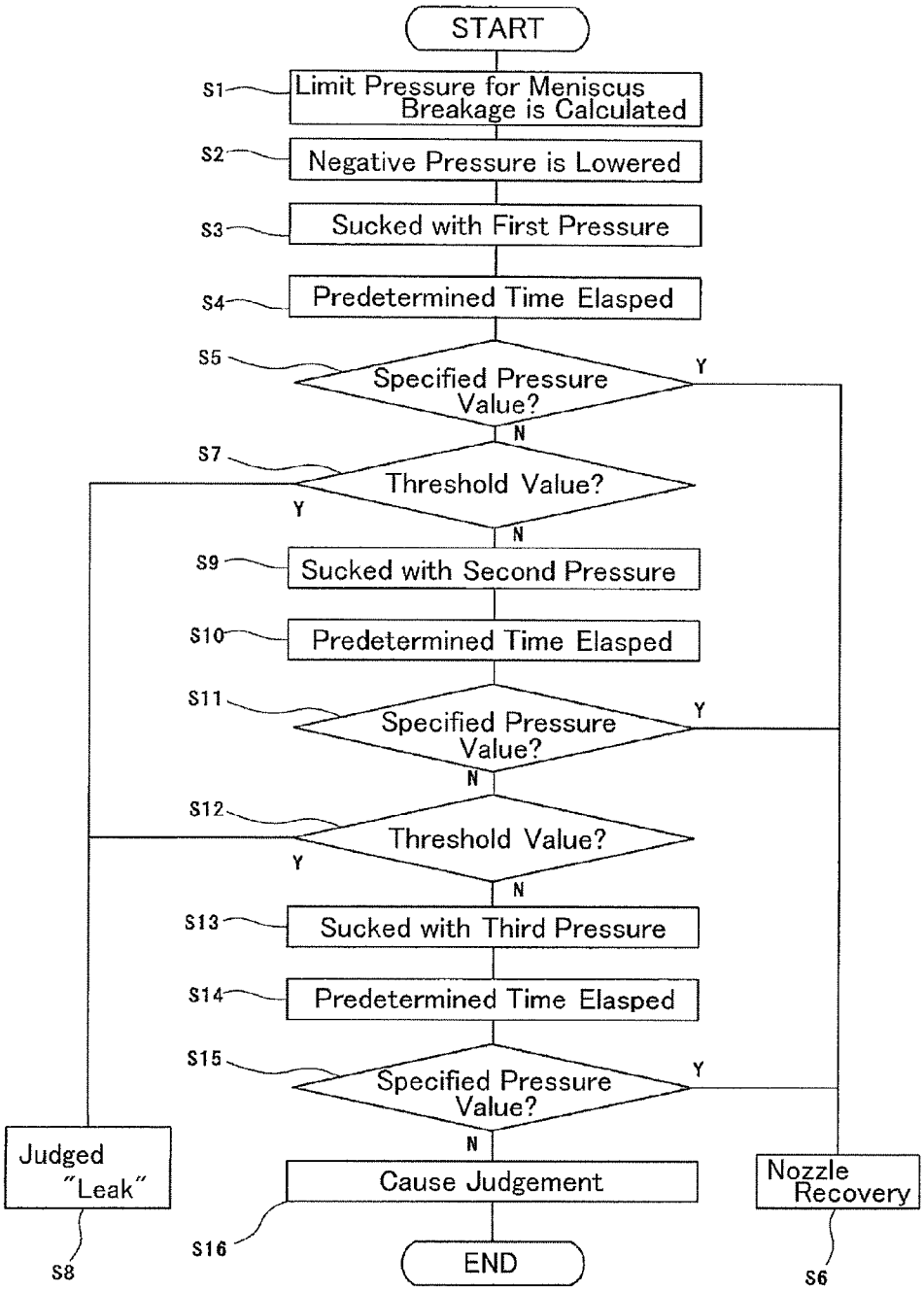
FIG. 6 is a flow chart showing a process in which a leak judgment and a recovery judgment from clogging of a nozzle are performed.
Figure 7A:
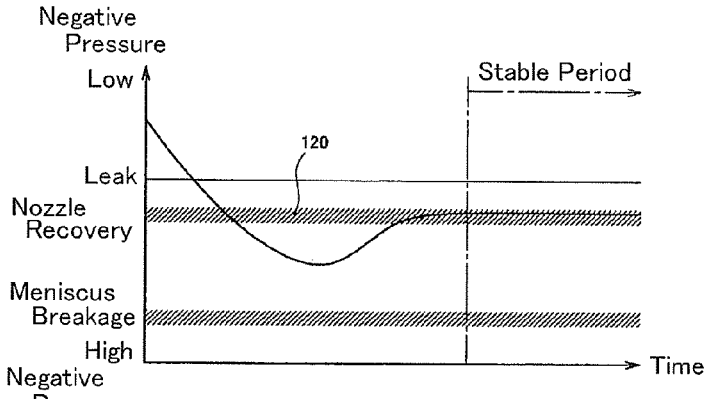
FIGS. 7(*a*) through 7(*d*) are graphs showing a variation of a pressure in an inside of a cap.
Figure 7B:
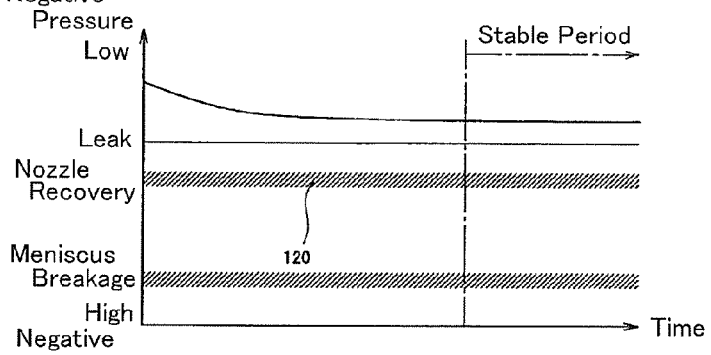
Figure 7C:
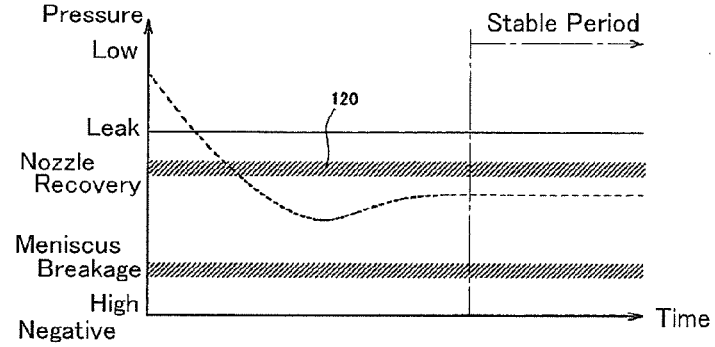
Figure 7D:
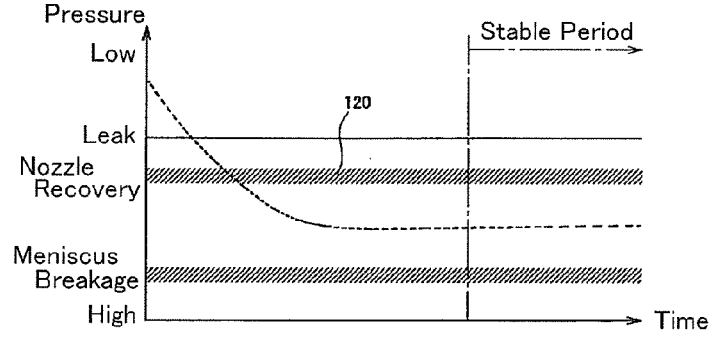
Figure 8A:
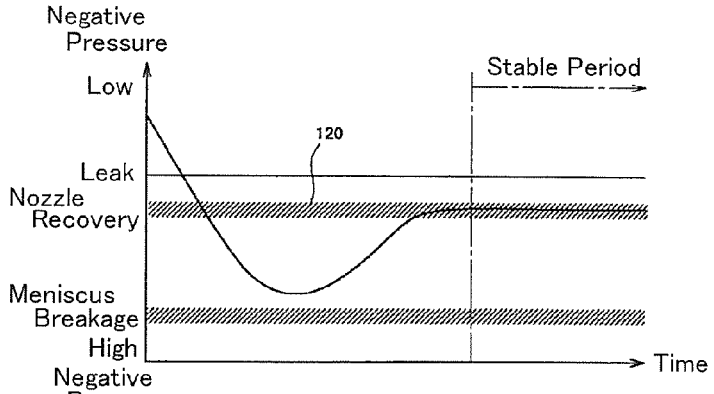
FIGS. 8(*a*) through 8(*d*) are graphs showing a variation of a pressure in an inside of a cap.
Figure 8B:
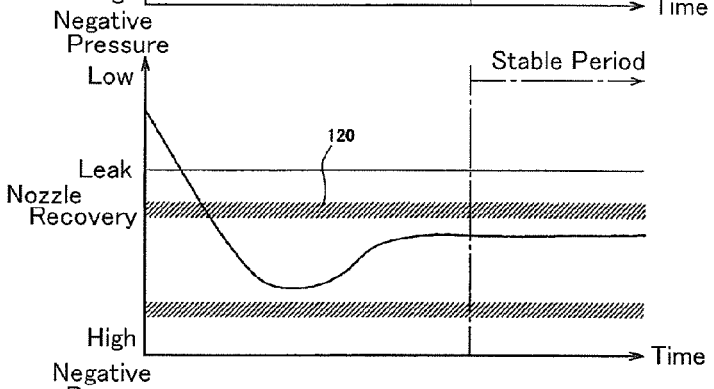
Figure 8C:
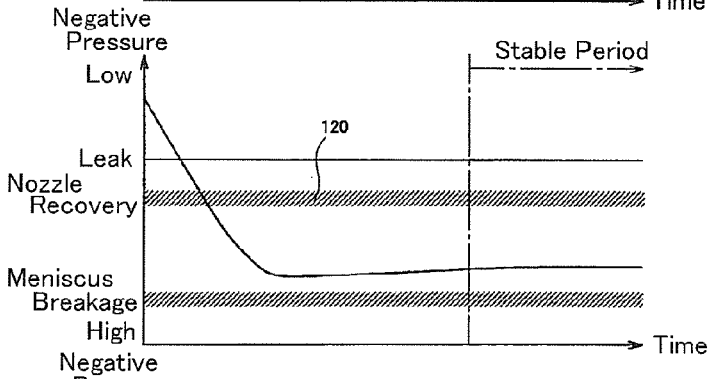
Figure 8D:
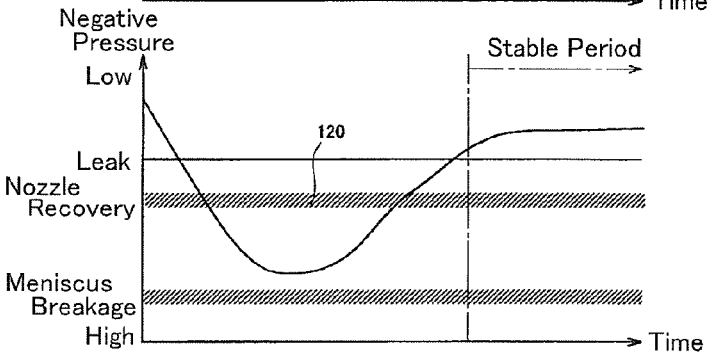
Figure 9A:
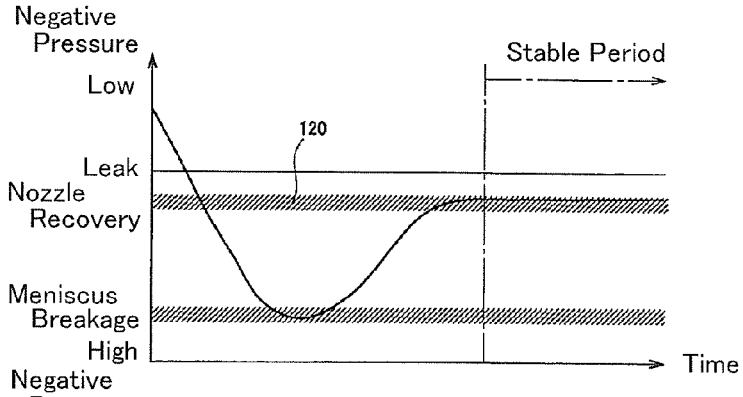
FIGS. 9(*a*) through 9(*d*) are graphs showing a variation of a pressure in an inside of a cap.
Figure 9B:
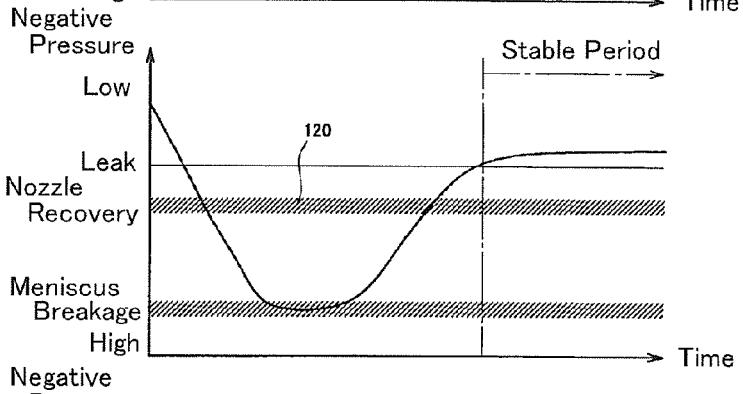
Figure 9C:
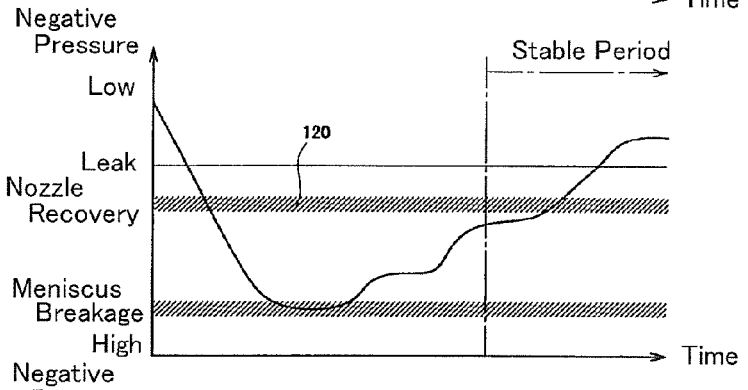
Figure 9D:
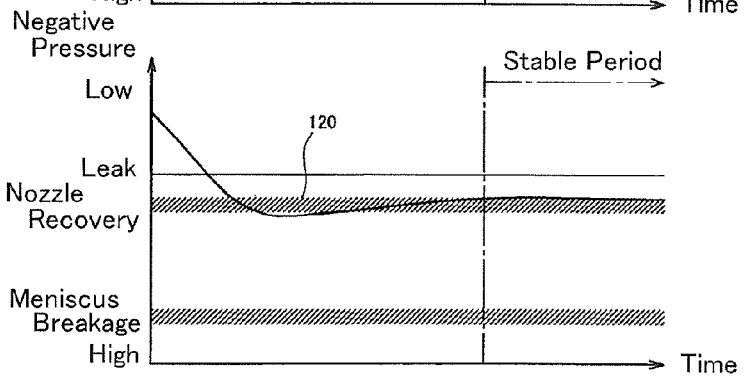

FIG. 6 is a flow chart showing a process in which a leak judgment and a recovery judgment of the nozzle are performed.

First, the cap 1 is located in the "A3" region where the clogged nozzles are detected by the above-mentioned process for a judgment of a clogged nozzle and the "A3" region is covered with the cap 1. First, a limit pressure at which a meniscus is broken is calculated (step S1).

The nozzles 103 in other regions are not covered by the cap 1 and are opened and thus, when the inside of the cap 1 is excessively sucked, the inside of the head 101 is sucked more than a specified value and ink in the nozzle 103 in the other regions is drawn to cause a meniscus to be broken. A pressure at which a meniscus of one nozzle 103 is broken is determined depending on various conditions such as a nozzle diameter, a length and viscosity of ink. These are obtained experimentally. Therefore, a limit pressure at which meniscuses in other regions are broken is obtained by multiplying an individual limit pressure reaching to breakage of a meniscus for each nozzle by the number of nozzles 103 without being clogged. Since the number of the clogged nozzles 103 is different for each region, a limit pressure for the breakage of the meniscus is different.

Next, the negative pressure in the sub-tank 104 is lowered by the first pump 8 so as not to occur breakage of a meniscus. (step S2). Normally, the inside of the sub-tank 104 is set at the negative pressure of −3 kPa by the first pump 8 so as to form a meniscus in the nozzle 103. However, the negative pressure is set to be lowered to −2 kPa by an instruction from the control part 7. In this manner, at the time of suction, a load to the nozzles 103 in other regions which are opened is reduced. In other words, when the negative pressure in the inside of the head 101 becomes higher by sucking the nozzles 103 in the "A3" region, ink of the nozzles 103 in other regions may be drawn to cause the meniscus to break. However, in this embodiment, since the negative pressure in the sub-tank 104 is lowered, a pressing force is acted on the ink of the nozzles 103 in the other regions and thus the ink is hard to be drawn into the inside of the head. On the other hand, in the "A3" region, the ink in the nozzles 103 is easy to be sucked by the cap 1 and thus clogging of the nozzle 103 is easy to be recovered.

In this case, a pressure adjustment in the inside of the sub-tank 104 is required to perform in a range where the meniscus of the nozzle 103 is not broken. When the pressure in the inside of the sub-tank 104 is excessively increased up to about atmospheric pressure, a meniscus which is formed in a convex shape due to surface tension is broken and the ink is oozed out on the nozzle face 102. The oozing pressure in this case (which is a pressure at which the meniscus in a convex shape is broken and ink is oozed out and this is different from a case that the meniscus in a concave shape is broken) may be obtained by multiplying a pressure oozing out per a nozzle determined depending on its nozzle diameter and the like by the number of the nozzles 103 without being clogged.

Next, the second pump 4 is driven in a state that the cap 1 is covered and the inside of the cap 1 is sucked at a first pressure by the second pump 4 while being monitored by the pressure sensor 2 (step S3). The first pressure is set to be a pressure having a margin in consideration of a pressure increase by the sub-tank 104 so that breakage of a meniscus is not occurred. In other words, even when suction is performed at a high negative pressure such that breakage of a meniscus may be occurred, a pressure increase by the sub-tank 104 is applied as a buffer and thus, suction with the high negative pressure does not occur breakage of a meniscus. As a result, since the suction force in the nozzle 103 can be set higher, the nozzle 103 is easily recovered.

In a case that the inside of the cap 1 is sucked at the first pressure, two nozzles 103 are clogged and thus, as shown in FIG. 7(*a*), the pressure in the inside of the cap 1 gradually goes down from start of suction. Then, when clogging of the nozzle 103 is eliminated by the suction and the nozzle 103 is recovered normally, the negative pressure in the inside of the cap 1 is lowered and, after that, the negative pressure is stabilized to the reference pressure value 120. The reference pressure value 120 is a pressure value which is required to suck ink from all nozzles 103 in the inside of the cap 1 under the condition that the negative pressure of the sub-tank 104 is lowered. A certain time period is required from the start of suction for suction itself and for gradually eliminating clogging of the nozzle 103 and thus recovery of the nozzle 103 is judged from a pressure value in a stable period after a certain predetermined time period has elapsed (steps S4 and S5). When the pressure value in the stable period is substantially the same as the reference pressure value 120, it is determined that all nozzles 103 are recovered (step S6). The stable period should be minimized because ink flows into the waste liquid tank 5 and the ink is consumed uselessly.

On the other hand, when leakage occurs, as shown in FIG. 7(*b*), air flows into the cap 1 and thus the pressure in the inside of the cap 1 hardly goes down (step S7). A threshold value for leak determination is previously set by acquiring data from experimental results of a pressure in the inside of the cap 1 when leakage occurs and, in a case that the negative pressure in the inside of the cap 1 does not become higher than the threshold value, it is judged that leakage has occurred (step S8). In a case that leakage has occurred, since air leaks from the outside from start of suction, an insufficient pressure is detected from the beginning of the suction.

In a case that only a part of nozzles 103 are recovered, as shown in FIG. 7(*c*), the negative pressure in the inside of the cap 1 is not lowered to the reference pressure value 120. When all nozzles 103 are not recovered, as shown in FIG. 7(*d*), a flat characteristic maintaining the pressure value is detected after start of the suction.

Next, in a case that the nozzles 103 are not recovered by the first pressure, the inside of the cap 1 is sucked with a second pressure (step S9). A target value of the second pressure is set to be a pressure lower than the first pressure. For example, the inside of the cap 1 is sucked at a negative target pressure which is a little lower than the limit pressure for the breakage of a meniscus in a state that an amount of pressure increase by the sub-tank 104 is applied as a buffer. A case that all nozzles 103 are not recovered will be described below. As shown in FIG. 8(*a*), when the inside of the cap 1 is sucked with the second pressure, since two nozzles 103 are clogged, the negative pressure in the inside of the cap 1 becomes gradually higher from start of suction. When clogging of the nozzles 103 is eliminated by the suction and the nozzles 103 are recovered normally, the negative pressure in the inside of the cap 1 is lowered and, after that, the negative pressure is stabilized to the reference pressure value 120. In a case that the pressure value in the stable period is smaller than the reference pressure value 120, it is determined that all nozzles 103 are recovered (steps S10 and S11).

In a case that only one of two nozzles 103 is recovered, as shown in FIG. 8(*b*), the pressure in the stable period becomes larger than the reference pressure value 120. When two nozzles 103 are not recovered, as shown in FIG. 8(*c*), the pressure becomes flat and is maintained in the stable period after the suction is started. Further, in a case that leakage occurs by applying the second pressure although the meniscus is not broken, the pressure in the inside of the cap 1 rapidly goes up and becomes stable at a small pressure value as shown in FIG. 8(*d*). In a case that the pressure exceeds a threshold value for leak judgment (step S12), it is determined that leakage has occurred (step S8).

Next, in a case that all nozzles 103 are not recovered, the inside of the cap 1 is sucked with a third pressure (step S13) and similar judgments described above are succeeded. The third pressure is set to be a negative pressure higher than the second pressure. For example, the inside of the cap 1 is sucked to a target pressure near the limit pressure for the breakage of a meniscus in a state that an amount of pressure increase by the sub-tank 104 is applied as a buffer. When sucked with the third pressure, the possibility that the meniscus is broken is increased but, breakage of a meniscus is actually affected by various conditions and thus the meniscus is not necessarily broken. Therefore, it is effective that suction is performed near the limit pressure.

As shown in FIG. 9(*a*), in a case that the inside of the cap 1 is sucked with the third pressure, when a pressure value in the inside of the cap 1 becomes substantially the same as the reference pressure value 120, it is determined that all nozzles 103 are recovered (steps S14, S15 and S6). When a part of the nozzles 103 are recovered, a flat output value is obtained with a pressure lower than the reference pressure value 120 (not shown). In other cases, for example, it is preferable that the cause is judged as follows (step S16).

FIG. 9(*b*) shows a variation of a pressure when the meniscus was broken. When the meniscus in a region other than the sucked region is broken, since air is entered into the head 101 from the nozzle 103, the negative pressure in the inside of the cap 1 is lowered rapidly. In this case, it is not recognized whether the breakage of the meniscus is occurred or leakage is occurred and thus it is judged depending on a pressure variation before a stable period. First, in a case that the negative pressure is in a lower state after start of the suction, it may be judged as a leak.

Next, in a case that a pressure value of the negative pressure becomes higher than the threshold value of leak after start of suction, it is required to determine whether the cause is leak or the breakage of a meniscus. The breakage of a meniscus is not necessarily occurred simultaneously in all nozzles 103 but, once leakage occurs, a large amount of air is entered into the inside of the cap 1 and thus, as shown in FIG. 9(*b*), a feature is appeared on a rising angle from the peak of the pressure value. Therefore, a case of swift rising is judged that leakage has occurred. Since the breakage of a meniscus is considered to successively occur by a nozzle unit, as shown in FIG. 9(*c*), rising of the pressure is slow or unstable and thus, it is judged that the meniscus is broken.

In the case of leakage, since the head 101 is not provided with a critical problem, it may be sufficient that the cap 1 is exchanged and the nozzle recovery processing is performed again. On the other hand, in the case of breakage of the meniscus, since clogging of the nozzle 103 cannot be recovered by suction through the cap 1, it is preferable that the head 101 is exchanged or the head 101 is detached and washed.

In a case that either the breakage of a meniscus or the nozzle recovery is to be judged, when the nozzles 103 are recovered, the reference pressure value 120 based on the number of the nozzles should be outputted and thus, when the outputted value is within a range of a value comprised of the reference pressure value 120 and a certain error, it is judged as recovery of the nozzle 103 and, when except the range, it is judged as breakage of a meniscus.

Finally, when nozzle recovery is to be checked, the corresponding region is covered with the cap 1 and is sucked with the reference pressure value 120. In this case, as shown in FIG. 9(*d*), the negative pressure in the inside of the cap 1 does not become higher than the reference pressure value 120 as the nozzle recovery and becomes stable. Further, checking for the nozzle recovery is performed without increasing the pressure of the sub-tank 104.

After recovery of the nozzles 103 is performed in the "A3" region as described above, the cap 1 is relatively moved to the "A6" region where the nozzles 103 are clogged and the "A6" region is covered with the cap 1 and then recovery of the nozzles 103 is performed according to the above-mentioned similar procedure.

As described above, according to the nozzle suction device 100 in accordance with the present invention, the nozzles 103 are recovered without breaking a meniscus. Further, suction is performed by changing the pressure in multiple stages and thus a possibility of breakage of a meniscus is extremely lowered. In addition, since leakage of the cap 1 can be judged, an error judgment is prevented in a recovery operation of the nozzle 103.

Further, in the first embodiment, it may be structured that a suction pressure by the second pump 4 is set to be constant and the pressure of the first pump 8 may be set in multiple stages. When the pressure of the sub-tank 104 goes up, since a water head acting on the nozzle face 102 becomes larger, suction is easily performed through the cap 1. For example, as the first stage, the inside of the cap 1 is sucked with a constant target pressure by the second pump 4 in a state that the negative pressure in the sub-tank 104 is lowered from −3 kPa to −2.5 kPa. In a case that recovery of the nozzle 103 is not attained even when the above-mentioned suction is performed, the inside of the cap 1 is sucked by the second pump 4 in a state that the negative pressure in the sub-tank 104 is lowered from −2.5 kPa to −2 kPa and then, recovery of the nozzle 103 is judged similarly to the above-mentioned embodiment. Also in this method, similar effects are obtained.

Second Embodiment

Figure 10:
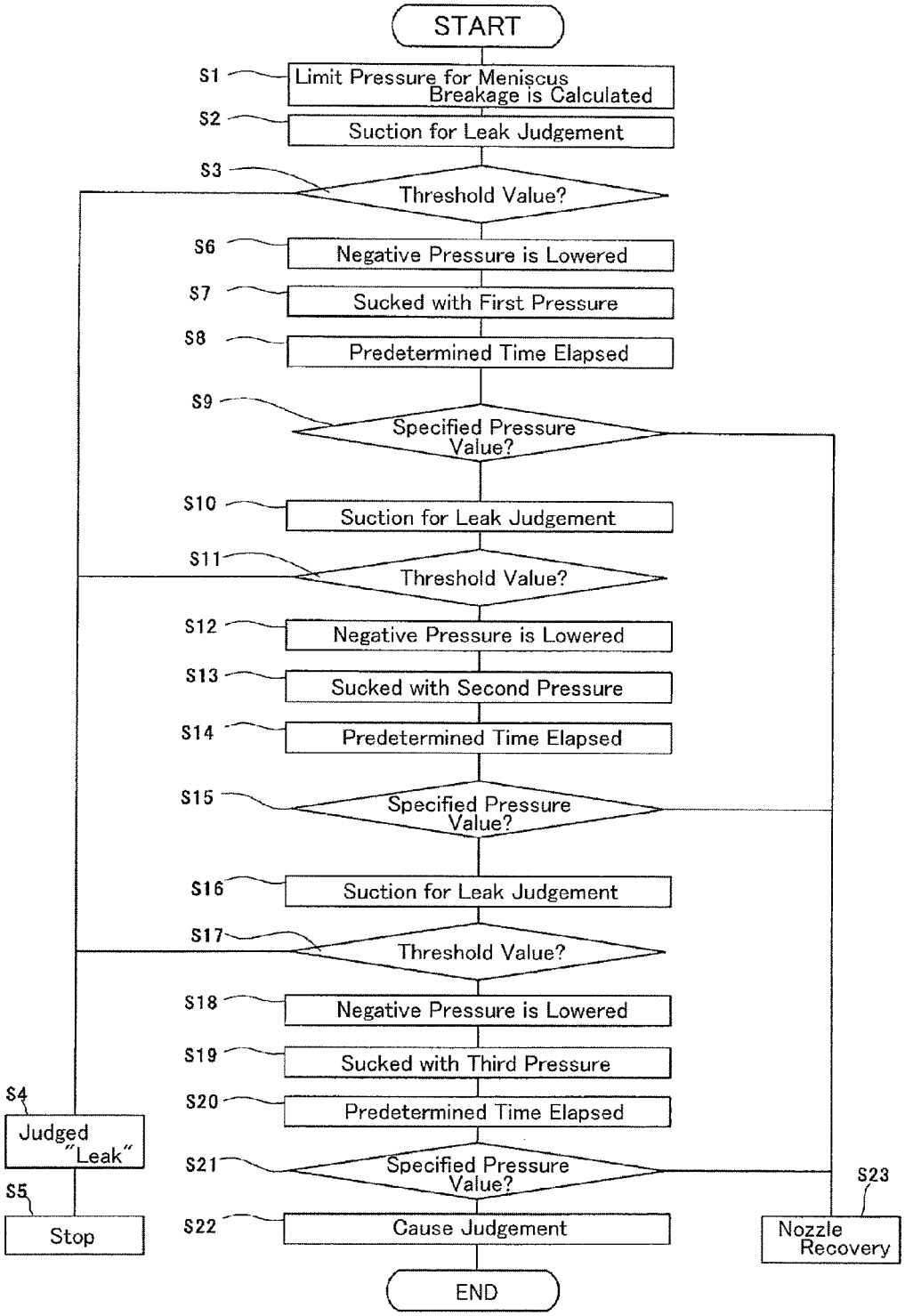
FIG. 10 is a flow chart showing an operation of a nozzle suction device in accordance with a second embodiment of the present invention.
Figure 11:
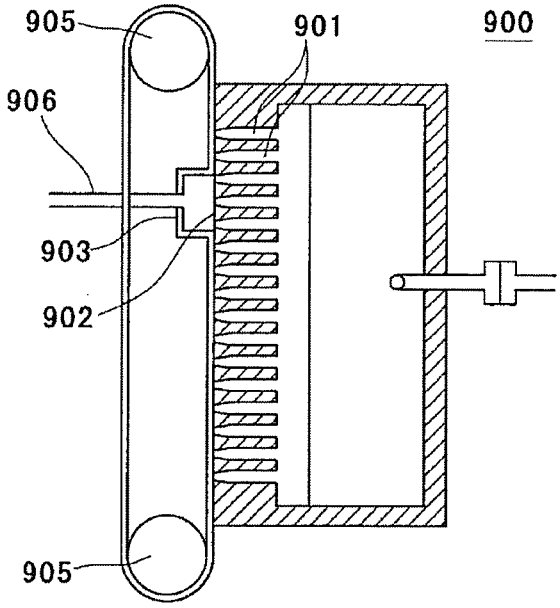
FIG. 11 (RELATED ART)
FIG. 11 is a structural view showing a cap unit which is used for recovering a conventional inkjet head.

FIG. 10 is a flow chart showing an operation of a nozzle suction device in accordance with a second embodiment of the present invention. When suction is performed in a state that leakage occurs from the cap 1, the ink which should be originally sucked is remained in the inside of the head 1 and thus, in a case that the negative pressure of the sub-tank 104 is lowered, the meniscus of the nozzle 103 may be broken and ink is oozed.

Therefore, an inspection for leakage of the cap 1 is performed in advance. First, the cap 1 is positioned in "A3" region where nozzle clogging is detected by the process of the nozzle clogging judgment and the "A3" region is covered with the cap 1. First, a limit pressure at which breakage of a meniscus is occurred is calculated (step S1). In this state, the inside of the cap 1 is sucked with a negative pressure lower than the limit pressure which occurs breakage of the meniscus (step S2). And, the pressure in the inside of the cap 1 is measured by the pressure sensor 2 to judge whether leakage occurs or not (step S3). In a case that leakage has occurred, as shown in FIG. 7(*b*), air flows into the cap 1 and the negative pressure in the inside of the cap 1 hardly becomes higher and thus it is judged that leakage has occurred (step S4).

In a case that leakage has occurred, when the negative pressure in the inside of the sub-tank 104 is excessively lowered, the meniscus may be broken and thus, at least lowering of the negative pressure of the sub-tank 104 is stopped (step S5). On the other hand, when it is judged that leakage does not occur, the negative pressure in the sub-tank 104 is lowered by the first pump 8 (step S6) in a similar procedure to the first embodiment and the cap 1 is sucked with the first pressure (step S7). After that, judgment of recovery of the nozzle 103 is performed similarly to the first embodiment (steps S8 and S9).

Further, when the recovery of the nozzle 103 is not attained by the first pressure, the inside of the cap 1 is sucked with a negative pressure higher than the negative pressure at the time of leak judgment relating to the first pressure (step S10). And, the pressure in the inside of the cap 1 is measured by the pressure sensor 2 to determine whether leakage occurs or not (step S11). In a case that leakage occurs, air flows into the cap 1 and the negative pressure in the inside of the cap 1 hardly becomes higher and thus it is judged that leakage has occurred (step S4). On the other hand, when it is judged that leakage does not occur, the pressure in the sub-tank 104 is gone up by the first pump 8 (step S12) in a similar procedure to the first embodiment and the cap 1 is sucked with the second pressure (step S13). After that, judgment of recovery of the nozzle 103 is performed similarly to the first embodiment (steps S14 and S15).

Further, when the recovery of the nozzle 103 is not attained by the second pressure, the inside of the cap 1 is sucked with a negative pressure higher than the negative pressure at the time of leak judgment relating to the second pressure (step S16). And, similarly to the above-mentioned case, the pressure in the inside of the cap 1 is measured by the pressure sensor 2 to determine whether leakage occurs or not (step S17). In a case that leakage occurs, air flows into the cap 1 and the negative pressure in the inside of the cap 1 hardly becomes higher and thus it is judged that leakage has occurred (step S4). On the other hand, when it is judged that leakage does not occur, the pressure in the sub-tank 104 is lowered by the first pump 8 (step S18) in a similar procedure to the first embodiment and the cap 1 is sucked with the third pressure (step S19). After that, judgment of recovery of the nozzle 103 is performed similarly to the first embodiment (steps S20 and S21).

As described above, since leak judgment is performed before a negative pressure of the sub-tank 104 is lowered, a meniscus of the nozzle 103 is prevented from being broken and ink is prevented from oozing out due to lowering of a negative pressure of the sub-tank 104.

What is claimed is:

1. An inkjet printing apparatus comprising:

a head which is provided with a nozzle face and a plurality of nozzles, wherein the plurality of nozzles are provided on the nozzle face for discharging ink;

a tank which stores ink and is connected with the head through a tube;

a first pump which is connected with the tank and maintains the tank at a constant negative pressure;

a cap for suction which covers a part of the plurality of nozzles on the nozzle face of the head;

a second pump which is connected with the cap for sucking an inside of the cap; and a control means which controls to lower the negative pressure of the tank that is maintained by the first pump when the inside of the cap is sucked by the second pump, wherein the control means further controls suction of the first pump based on number of the plurality of nozzles without being clogged in a region where the cap is not covered.

2. The inkjet printing apparatus according to claim 1, wherein when the negative pressure in the inside of the tank is lowered by the first pump, the control means sucks the inside of the cap with a first pressure lower than a negative pressure which breaks a meniscus of the plurality of nozzles without being clogged in a region which is not covered with the cap, after that, the control means sucks the inside of the cap with a second pressure which is a negative pressure higher than the first pressure.

3. The inkjet printing apparatus according to one of claim 1, further comprising a leak judgment means which judges leakage of the cap before suction is performed by the first pump.

4. A clogged nozzle recovering method comprising:

a covering step in which a part of a plurality of nozzles formed on a nozzle face of a head of an inkjet printer are covered with a cap;

a pressurizing step in which an inside of a tank storing ink that is connected with the head through a tube is pressurized by a first pump;

a suction step in which an inside of the cap is sucked by a second pump connected with the cap at a pressure lower than a negative pressure which breaks a meniscus of the plurality of nozzles in a region where the cap is not covered;

a nozzle recovery judgment step which judges recovery of the plurality of nozzles by comparing a reference pressure value with a pressure value, wherein the reference pressure value is obtained when the plurality of nozzles without being clogged are covered with the cap and sucked and is stored beforehand, the pressure value is obtained when the plurality of nozzles are covered with the cap and sucked; and a suction force control step in which suction of the first pump is controlled based on number of clogged nozzles in the region where the cap is not covered.

5. The clogged nozzle recovering method according to claim 4, wherein in the suction step, when a negative pressure of the tank is lowered by the first pump, the inside of the cap is sucked with a first pressure which does not break a meniscus of the plurality of nozzles without being clogged in the region which is not covered with the cap, after that, the inside of the cap is sucked with a second pressure which is a negative pressure higher than the first pressure.

6. The clogged nozzle recovering method according to one of claim 5, further comprising a leak judgment step in which leakage of the cap is judged by comparing a pressure value with a threshold value, wherein the pressure value is a value of a pressure when sucking the inside of the cap, the threshold value is stored beforehand for leak judgment.

* * * * *